US005322362A

United States Patent [19]

Smith

[11] Patent Number: 5,322,362

[45] Date of Patent: Jun. 21, 1994

[54] BAG EXPANDING FILLER

[75] Inventor: Michael J. Smith, Orangeburg, N.Y.

[73] Assignee: Arrow Art Finishers, Inc., Bronx, N.Y.

[21] Appl. No.: 138,234

[22] Filed: Oct. 15, 1993

[51] Int. Cl.[5] ..... A45C 7/00

[52] U.S. Cl. ..... 383/127; 383/33

[58] Field of Search ..... 383/127, 33, 35, 104, 383/119

[56] References Cited

U.S. PATENT DOCUMENTS

| | | | |
|---|---|---|---|
| 4,077,451 | 3/1978 | Zoland | 383/127 |
| 4,141,399 | 2/1979 | Zoland | 383/127 X |
| 4,142,564 | 3/1979 | Zoland | 383/127 |
| 4,946,292 | 8/1990 | Diamond et al. | 383/127 |
| 4,969,751 | 11/1990 | Diamond et al. | 383/127 |
| 4,993,846 | 2/1991 | Diamond et al. | 383/127 |
| 5,030,014 | 7/1991 | Diamond et al. | 383/127 |
| 5,179,600 | 1/1993 | Bailey et al. | 383/127 |
| 5,259,674 | 11/1993 | Hedaya et al. | 383/127 |

*Primary Examiner*—Allan N. Shoap
*Assistant Examiner*—Jes F. Pascua
*Attorney, Agent, or Firm*—Kirschstein, Ottinger, Israel & Schiffmiller

[57] ABSTRACT

A filler automatically expands a soft bag from a collapsed to an expanded condition. An elastic band urges a pair of panels apart. The band is mounted on a flap which is integrally hinged, and initially co-planar with, one of the panels.

9 Claims, 11 Drawing Sheets

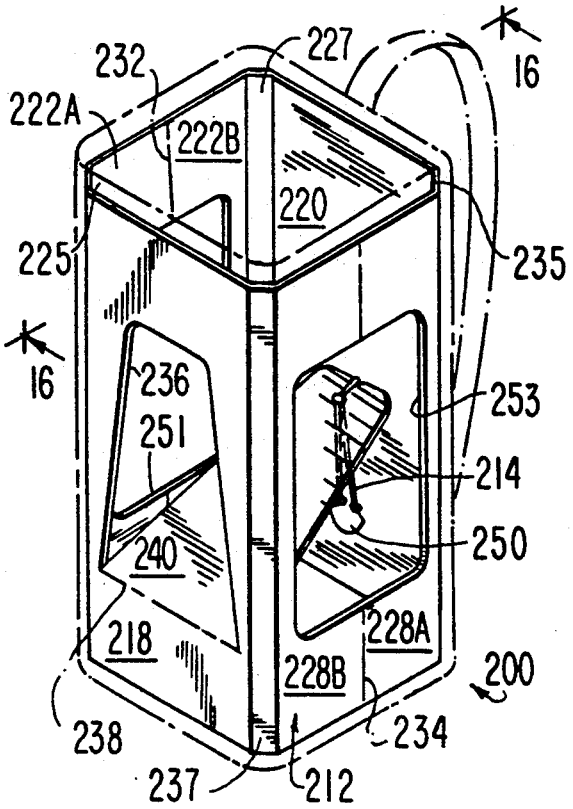
FIG. 15
FIG. 16
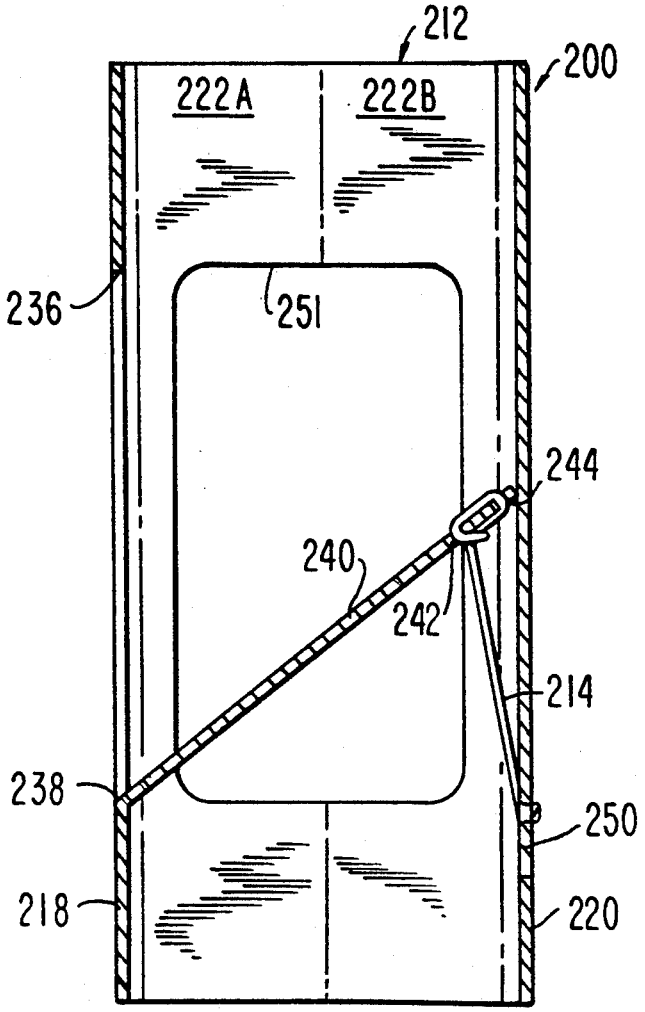

BAG EXPANDING FILLER

BACKGROUND OF THE INVENTION

1. Field of the Invention

This invention generally relates to a filler for automatically expanding a soft bag in all shapes and sizes, such as a purse, a suitcase, a tote bag, a backpack, a sports bag and like bags, for display purposes at a point-of-sale site.

2. Description of the Related Art

Soft bags are typically shipped from a manufacturer to a point-of-sale site in a generally collapsed condition to minimize shipping space and freight costs. At or near the point-of-sale site, the collapsed bags are stuffed, typically manually with crumpled wads of paper, inflated inserts, or corrugated board, rigid inserts of the type exemplified by U.S. Pat. Nos. 4,077,451; 4,141,399; 4,142,564; 4,969,751; 4,993,846; and 5,030,014.

Stuffing bags with paper wads is labor- and cost-intensive. Inflating inserts requires a source of a pressurized gas, and constant vigilance to resist gas leaks. The known rigid inserts disclosed in the above patents are assembled from multiple sheet members, thereby increasing manufacturing and labor costs, and sometimes such rigid inserts do not uniformly expand the soft bags.

SUMMARY OF THE INVENTION

Objects of the Invention

It is a general object of this invention to provide a cost-effective, reliable filler for automatically and uniformly expanding a soft bag.

Another object of this invention, is to enable a manufacturer to insert the filler into the soft bag for later expansion at the point-of-sale site.

Still another object of this invention is to eliminate the use and disposal of paper wads and/or inflated inserts.

Features of the Invention

In keeping with these objects and others which will become apparent hereinafter, one feature of this invention resides, briefly stated, in a filler for automatically expanding a soft bag from a collapsed condition to an expanded condition. The filler comprises an insert including a pair of generally planar, mutually parallel, sheet members, as well as biasing means for constantly biasing the sheet members apart from each other.

One of the sheet members has a slit therein bounding a generally planar flap. The flap is initially co-planar with said one sheet member. The flap is also integrally hinged with said one sheet member for pivoting movement between a generally flattened state in which the flap lies generally parallel to the other of the sheet members, and a deployed state in which the flap extends transversely between the sheet members. The biasing means is connected between the flap and the other sheet member.

The flap may either be co-planar with said one sheet member in the flattened state, or may be located between the sheet members in the flattened state. Advantageously, the flap has a generally trapezoidal shape.

The flap and the other sheet member each has mounting apertures. The biasing means, advantageously an elastic band, is mounted in the apertures.

In accordance with another feature of this invention, stop means are provided on the other sheet member, for abutting against the flap in the deployed state. The stop means includes a tab extending from the other sheet member in a plane generally perpendicular to the other sheet member.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 15 is a perspective view of the filler of FIG. 14 in a deployed state within a tote bag shown in phantom lines;

FIG. 16 is an enlarged sectional view taken along line 16—16 of FIG. 15;

DETAILED DESCRIPTION OF THE PREFERRED EMBODIMENTS

Figure 1:
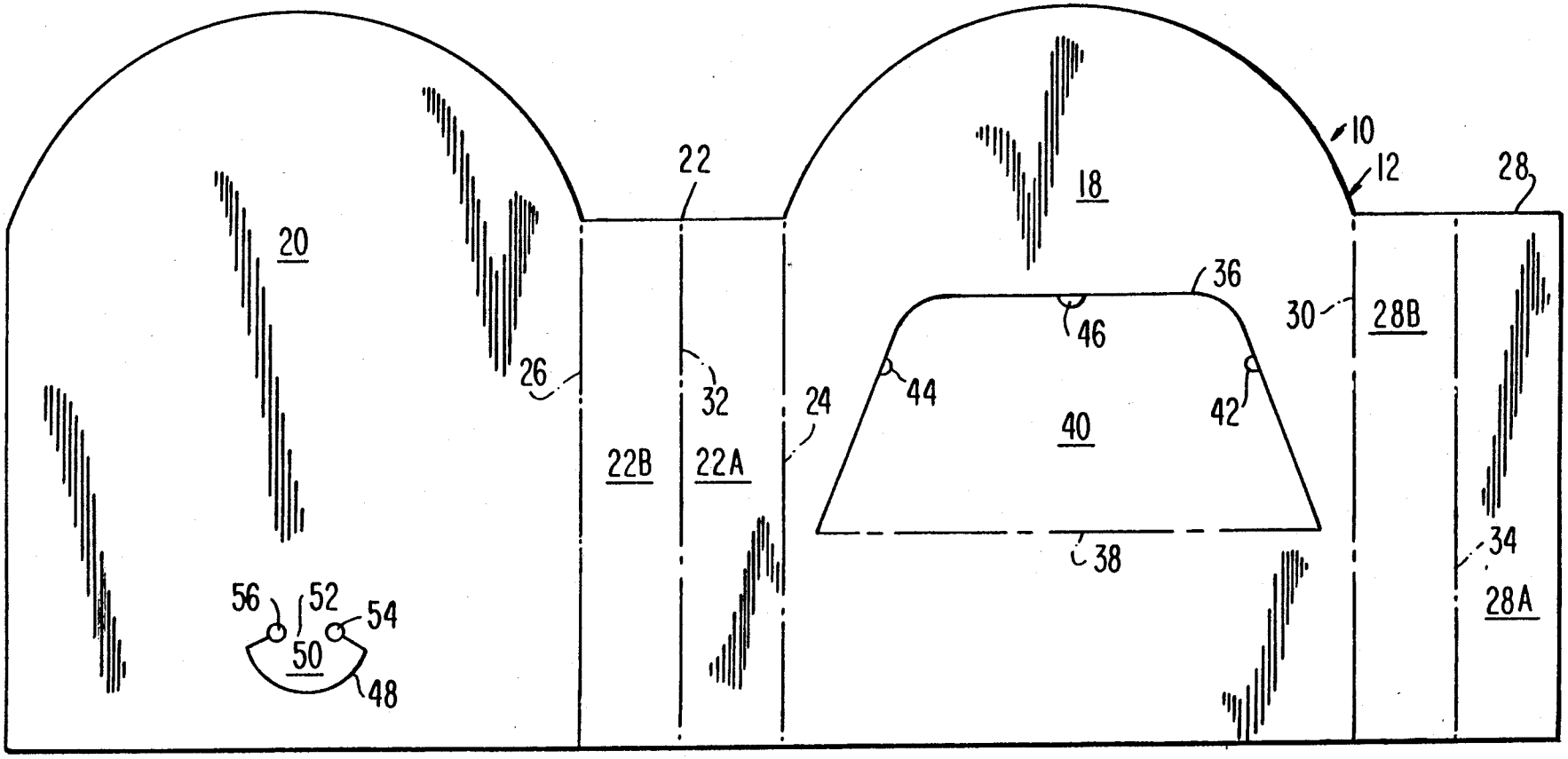
FIG. 1 is a top plan view of one embodiment of a filler after manufacture and before insertion into a soft bag in accordance with this invention.
Figure 2:
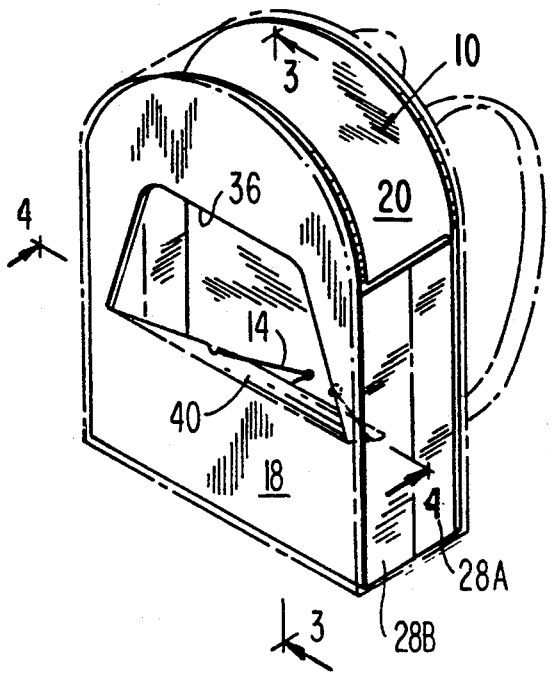
FIG. 2 is a perspective view of the filler of FIG. 1 in a deployed state within a backpack shown in phantom lines.
Figure 3:
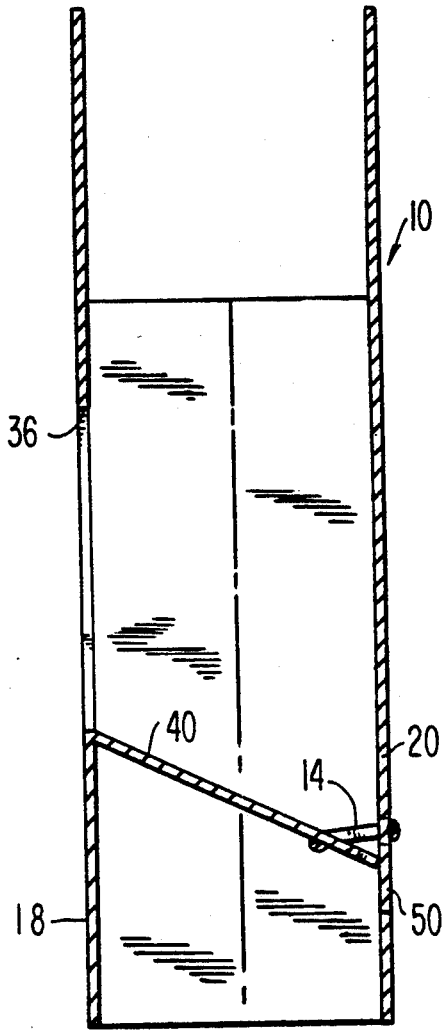
FIG. 3 is an enlarged sectional view taken along line 3—3 of FIG. 2.
Figure 4:
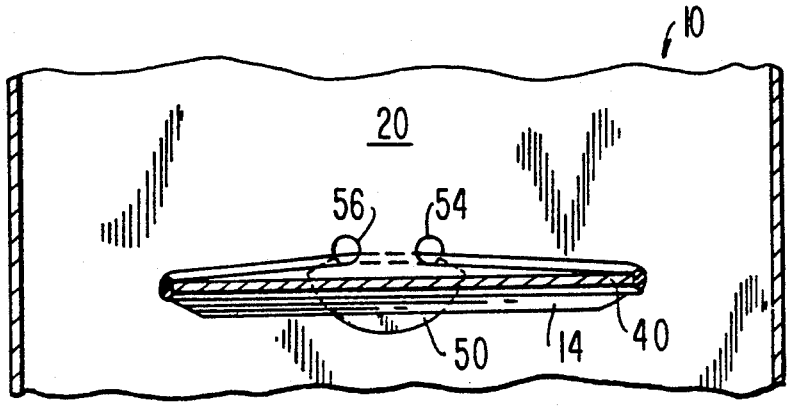
FIG. 4 is an enlarged, broken-away sectional view taken along line 4—4 of FIG. 2.

Referring now to FIGS. 1 through 7, a first embodiment of a filler 10 comprises a one-piece insert 12 and a resilient element 14. As best shown in FIG. 1, the insert 12 is constructed of a single piece of cardboard, corrugated board, or other suitable material by die cutting or other suitable manufacturing process. Insert 12 includes a pair of generally planar sheet members or panels 18, 20; a connecting member 22 integrally hinged to panels 18, 20 along mutually parallel fold lines 24, 26, respectively; and an end member 28 integrally hinged to panel 18 at fold line 30. Another fold line 32 parallel to fold lines 24, 26 centrally divides connecting member 22 to form a pair of sections 22A, 22B thereof. Another fold line 34 parallel to fold line 30 centrally divides end member 28 to form a pair of sections 28A, 28B thereof. Panels 18, 20 are identical in size, as are the connecting member 22 and the end member 28.

Panel 18 is formed with a three-sided slit 36 that bounds a generally trapezoidal, planar flap 40 that is integrally hinged to panel 18 along fold line 38 that extends perpendicularly to the fold lines 24, 30. A pair of mounting apertures 42, 44 for the resilient element 14, as described below, is formed in the flap 40, together with a fingernail notch 46.

Panel 20 is formed with a three-sided slit 48 that bounds a generally sector-shaped, planar tab 50 that is attached to panel 20 at web 52. A pair of mounting apertures 54, 56 for the resilient element 14 is formed in the panel 20 at opposite ends of the slit 48.

Once manufactured, the insert 12 is folded along fold lines 24, 26 so that panels 18, 20 overlie each other in mutual parallelism. End member 28 is folded along fold line 30 so that end member 28 and connecting member 22 are in mutual parallelism. Although it is preferable not to connect end member 28 to panel 20; in some cases, end member 28 is indeed connected to panel 20 by tape, glue, stapling, or other suitable connector.

Figure 5:
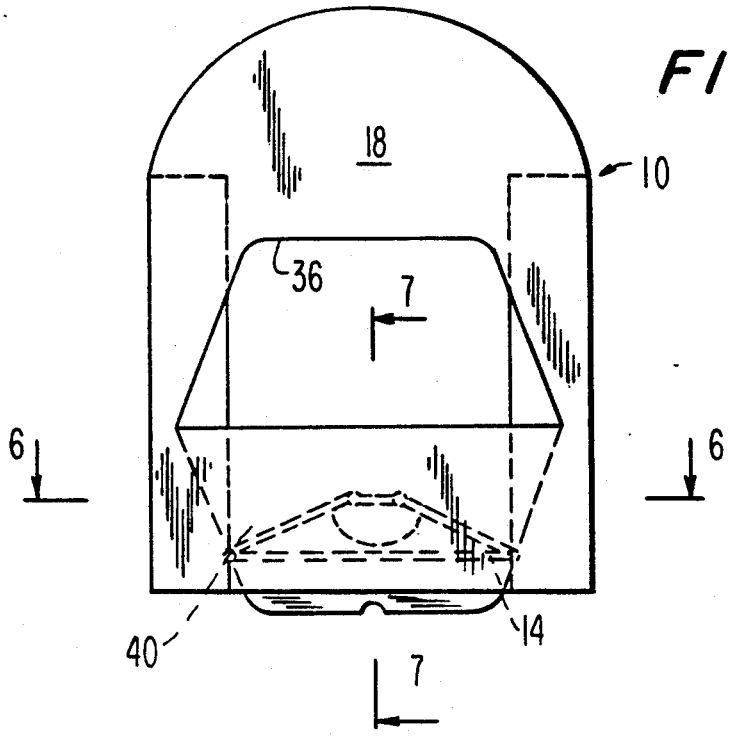
FIG. 5 is a front elevational view of the filler of FIG. 1 in a flattened state.
Figure 6:
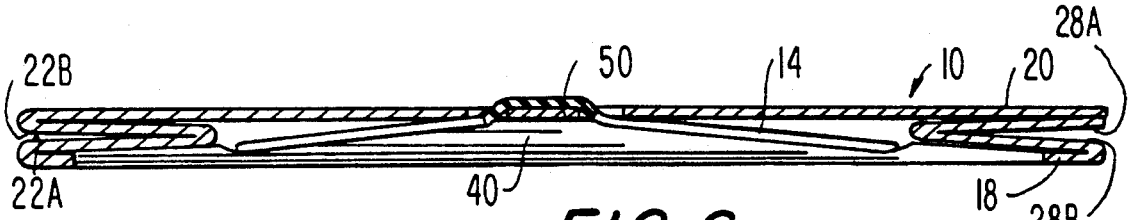
FIG. 6, is an enlarged sectional view taken along line 6—6 of FIG. 5.
Figure 7:
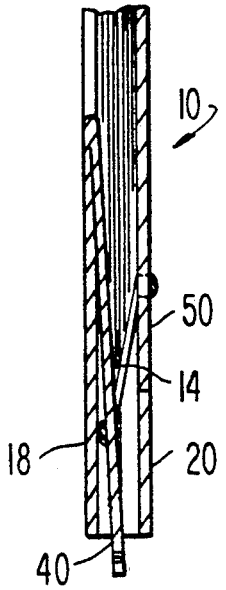
FIG. 7 is an enlarged, broken-away, sectional view taken along line 7—7 of FIG. 5.

The resilient element 14, advantageously a rubber band, is mounted on the insert 12. To that end, the flap 40 is pushed inwardly out of its initial co-planar relation with panel 18 to an intermediate position (see, for example, FIG. 7) between the panels 18, 20. Then, one end of the band is inserted through slit 36, mounted on the apertures 42, 44, and then pulled under tension through the slit 48, and then mounted on the apertures 54, 56. The stretched band is shown in FIGS. 5 through 7 wherein the insert is shown in a generally flattened, closed state. It is in this state that the insert is inserted into a soft bag, such as the backpack shown in phantom lines in FIG. 2. A compressive force must constantly be exerted against the panels 18, 20 to keep the band from pushing the panels 18, 20 apart to the deployed, open condition illustrated in FIGS. 2 through 4 in which the walls of the backpack are pushed outwardly to impart a filled, expanded appearance to the bag. The compressive force is typically exerted by the weight of other bags lying on top of the backpack in a shipping container. As the bags are unpacked, each unpacked bag, in its turn, is automatically expanded.

Figure 8:
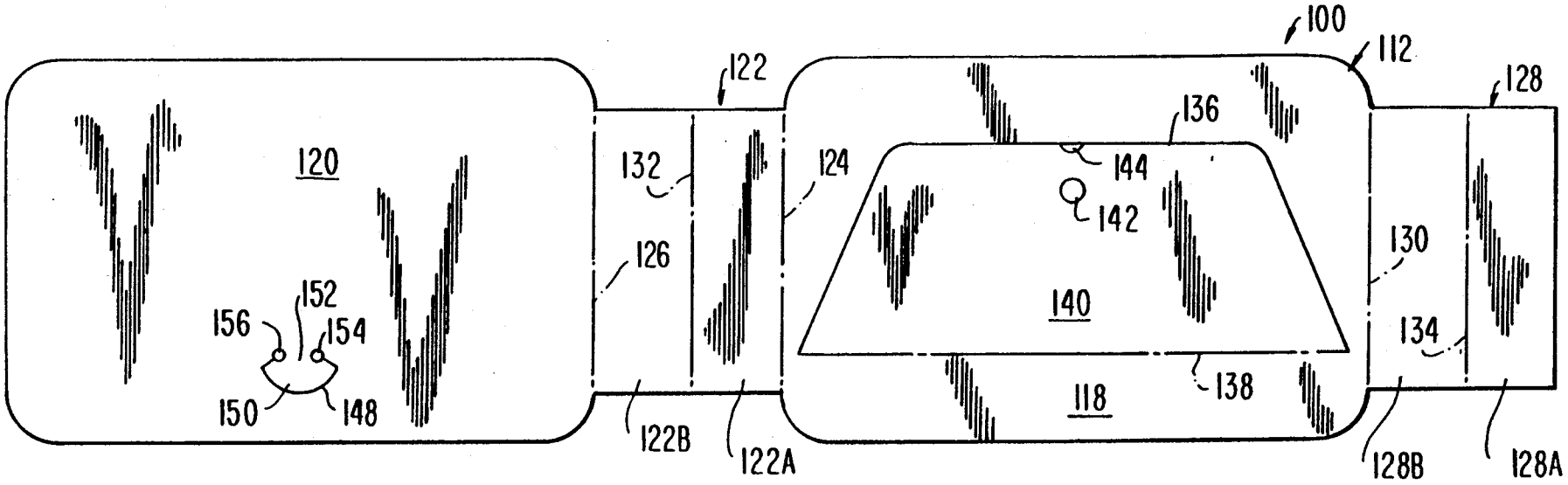
FIG. 8 is a top plan view of a second embodiment of a filler after manufacture and before insertion into a soft bag in accordance with this invention.
Figure 9:
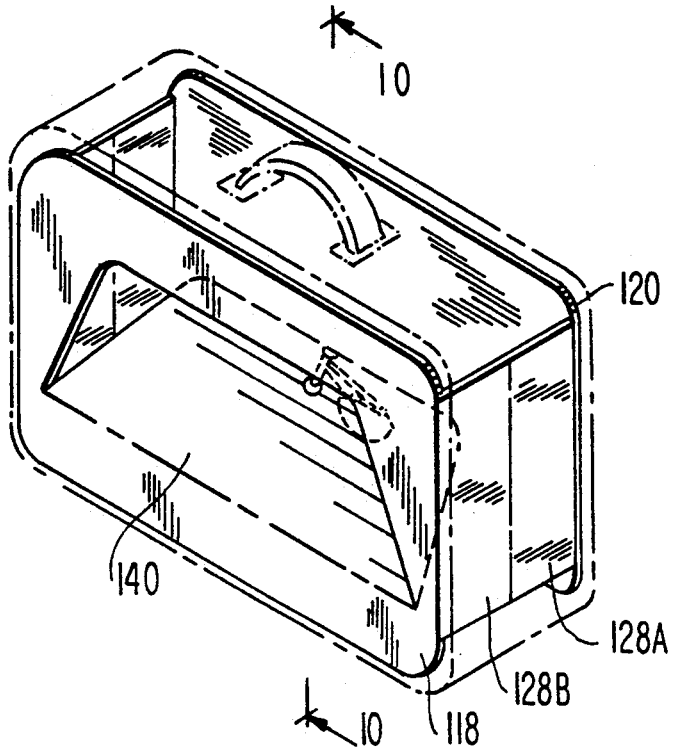
FIG. 9 is a perspective view of the filler of FIG. 8 in a deployed state within a suitcase shown in phantom lines.
Figure 10:
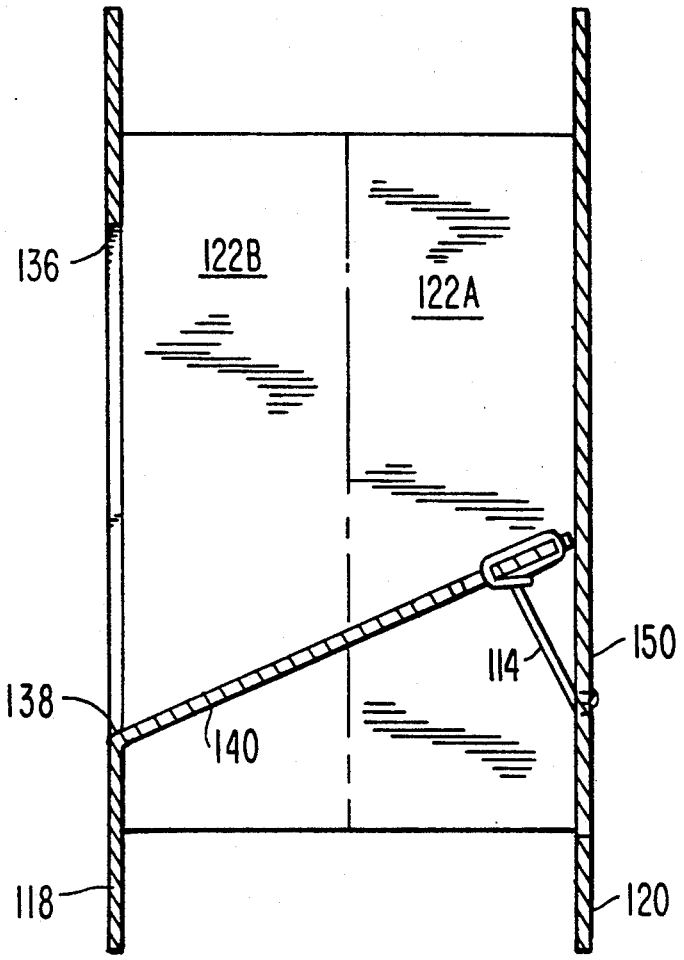
FIG. 10 is an enlarged sectional view taken along line 10—10 of FIG. 9.

Referring to FIGS. 8 through 13, a second embodiment of a filler 100 comprises a one-piece insert 112 and a resilient element 114. As best shown in FIG. 8, the insert 112 is constructed of a single piece of cardboard, corrugated board or the like. Insert 112 includes a pair of generally planar, sheet members or panels 118, 120; a connecting member 122 integrally hinged to panels 118, 120 along mutually parallel fold lines 124, 126, respectively; and an end member 128 integrally hinged to panel 118 at fold line 130. Another fold line 132 parallel to fold lines 124, 126 centrally divides connecting member 122 to form a pair of sections 122A, 122B thereof. Another fold line 134 parallel to fold line 130 centrally divides end member 128 to form a pair of sections 128A, 128B thereof. Panels 118, 120 are identical in size and have a generally rectangular configuration with rounded corners. End member 128 and connecting member 122 are also identical in size.

Panel 118 is formed With a three-sided slit ;36 that bounds a generally trapezoidal, planar flap 140 that is integrally hinged to panel 118 along fold line 138 that extends normal to the fold lines 124, 130. A pair of mounting apertures 142, 144 for the resilient element 114, as described below, is formed in the flap 140.

Panel 120 is formed with a three-sided slit 148 that bounds a generally sector-shaped, planar tab 150 that is attached to panel 120 at web 152. A pair of mounting apertures 154, 156 for the resilient element is formed in the panel 120 at opposite ends of the slit 148.

After manufacture, the insert 112 is folded along fold lines 124, 126 so that panels 118, 120 overlie each other in mutual parallelism. End member 128 is folded along fold line 130 so that end member 128 and connecting member 122 are also in mutual parallelism. Preferably, end member 128 is not connected to panel 120, but in some cases, such a connection may be desirable.

Figure 11:
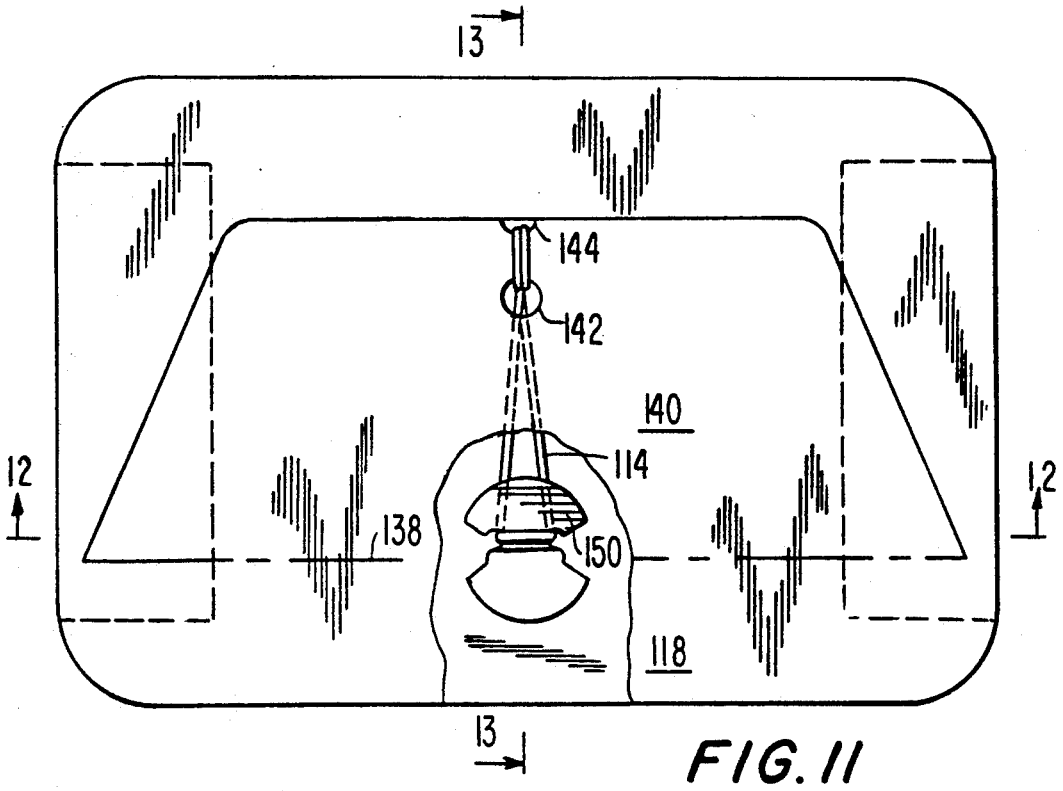
FIG. 11 is a front elevational view of the filler of FIG. 8 in a flattened state.
Figure 12:
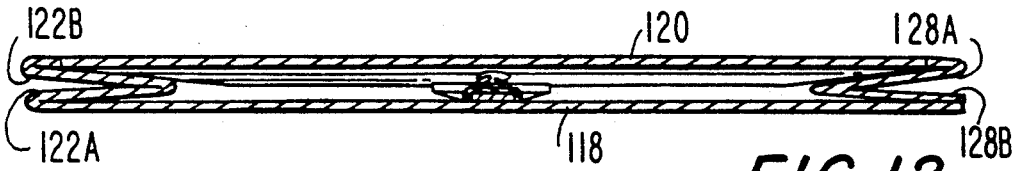
FIG. 12 is an enlarged sectional view taken along line 12—12 of FIG. 11.
Figure 13:
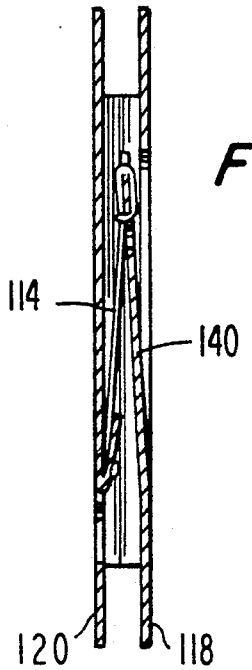
FIG. 13 is an enlarged sectional view taken along line 13—13 of FIG. 11.

The resilient element 114, advantageously a rubber band, is mounted on the insert 112. Flap 140 is pushed inwardly out of its initial co-planar relation with panel 118 to an intermediate position (see, for example, FIG. 13) between the panels 118, 120. Then, one end of the band is inserted through apertures 142, 144 and looped around itself, and then pulled under tension through the slit 148, and then mounted in the apertures 154, 156. The stretched band is shown in FIGS. 11 through 13, wherein the insert is in a generally flattened, closed state. It is in this state that the insert is inserted into a soft bag such as the suitcase shown in phantom lines in FIG. 9. As before, a compressive force must be exerted against the panels 118, 120 to keep the band from urging the panels 118, 120 apart to the deployed, open condition depicted in FIGS. 9 and 10.

Figure 14:
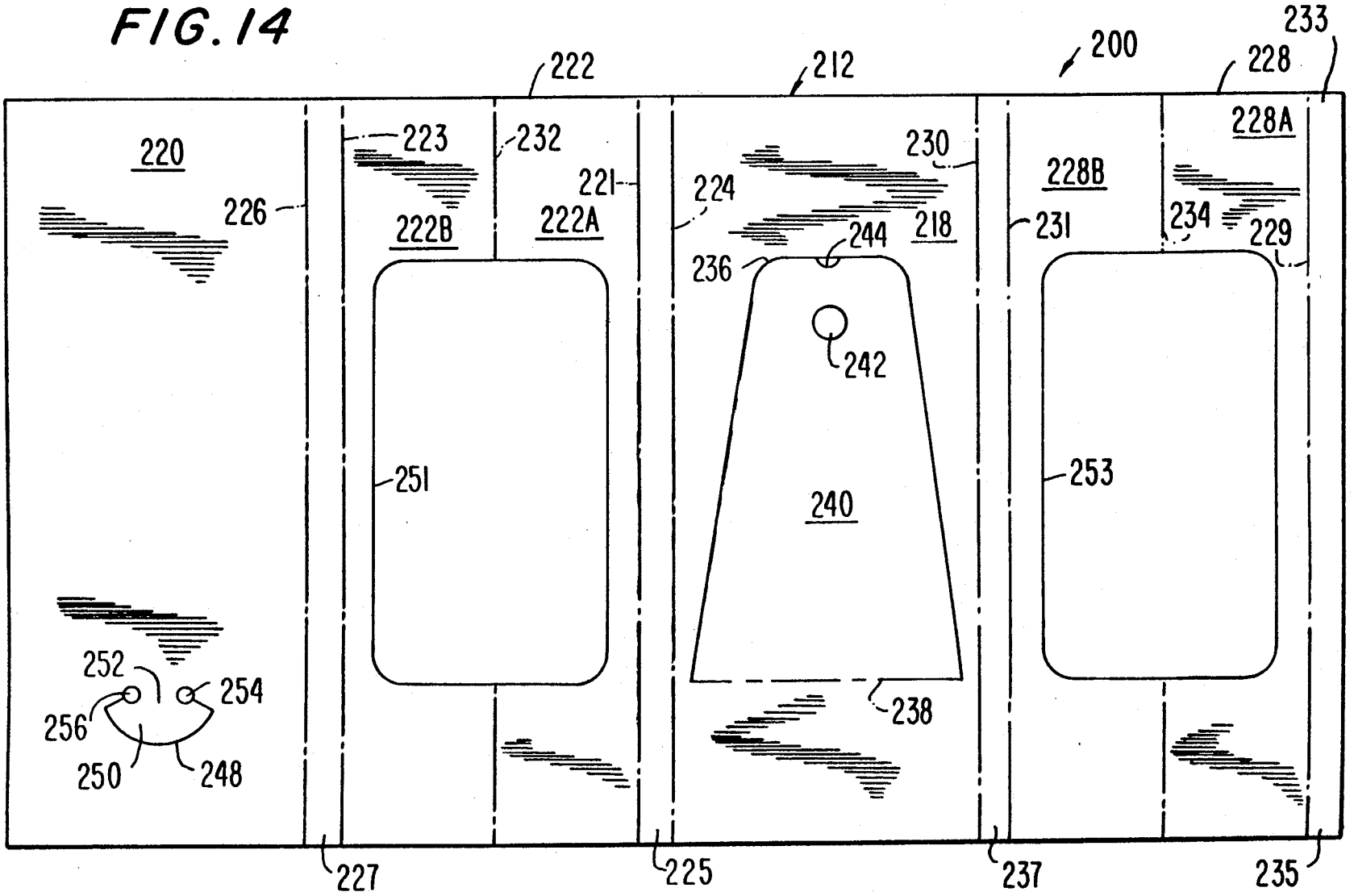
FIG. 14 is a top plan view of a third embodiment of a filler after manufacture and before insertion into a soft bag in accordance with this invention.

Referring next to FIGS. 14 through 19, a third embodiment of a filler 200 comprises a one-piece insert 212 and a resilient element 214. As best shown in FIG. 14, the insert 212 is constructed of a single piece of cardboard, corrugated board or the like. Insert 212 includes a pair of generally planar, sheet members or panels 218, 220; a connecting member 222 integrally hinged to panels 218, 220 along mutually parallel fold lines 224, 226, respectively; and an end member 228 integrally hinged to panel 218 at fold line 230. Another fold line 232 parallel to fold lines 224, 226 centrally divides connecting member 222 to form a pair of sections 222A, 222B thereof. Panels 228, 220 are identical in size and have a generally rectangular configuration. End member 228 and connecting member 222 are also identical in size and have a generally rectangular configuration. Additional fold lines 221, 223 are spaced from fold lines 224, 226 to form corner strips 225, 227. Further fold lines 229, 231 are spaced from peripheral edge 233 and fold line 230 to form additional corner strips 235, 237.

Panel 218 is formed with a three-sided slit 236 that bounds a generally trapezoidal, planar flap 240 that is integrally hinged to panel 218 along fold line 238 that extends normal to the fold lines 224, 230. A pair of mounting apertures 242, 244 for the resilient element 214, as described below, is formed in the flap 240.

Panel 220 is formed with a three-sided slit 249 that bounds a generally sector-shaped, planar tab 250 that is attached to panel 220 at web 252. A pair of mounting apertures 254, 256 for the resilient element is formed in the panel 220 at opposite ends of the slit 248.

Members 222, 228 have central, generally rectangular cutouts or windows 251, 253 to minimize the weight of the insert 212.

After manufacture, the insert 212 is folded along fold lines 224, 226, 221, 223 so that panels 218, 220 overlie each other in mutual parallelism. End member 228 is folded along fold lines 230, 231 so that end member 228 and connecting member 222 are also in mutual parallelism. Preferably, end member 228 is not connected to panel 220, but in some cases, such a connection may be desirable.

Figure 17:
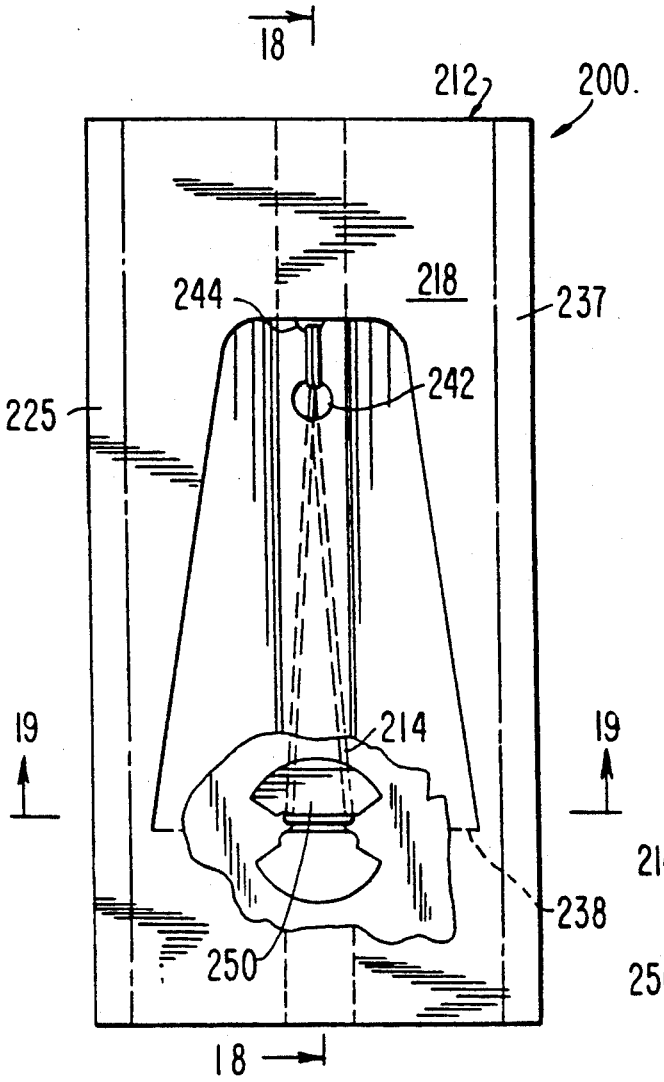
FIG. 17 is an enlarged front elevational view of the filler of FIG. 14 in a flattened state.
Figure 18:
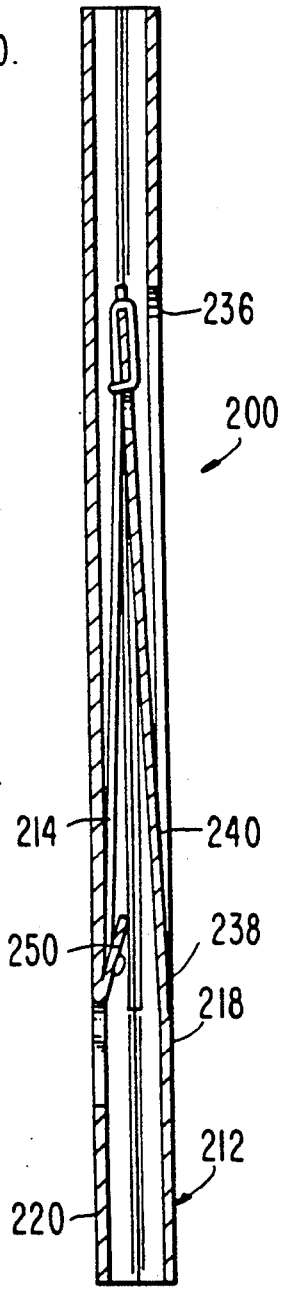
FIG. 18 is an enlarged sectional view taken along line 18—18 of FIG. 17.
Figure 19:
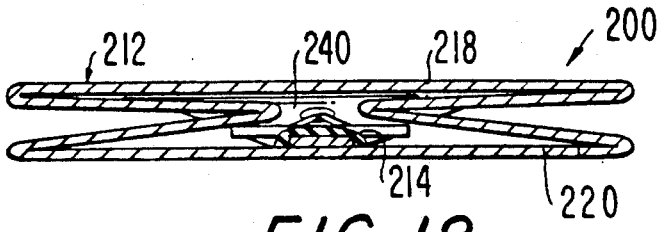
FIG. 19 is an enlarged sectional view taken along line 19—19 of FIG. 17.

The resilient element 214, advantageously a rubber band, is mounted on the insert 222. Flap 240 is pushed inwardly out of its initial co-planar relation with panel 218 to an intermediate position (see, for example, FIG. 16) between the panels 218, 220. Then, one end of the band is inserted through apertures 242, 244 and looped around itself, and then pulled under tension through the slit 248, and then mounted in the apertures 254, 256. The stretched band is shown in FIGS. 17 through 19, wherein the insert is in a generally flattened, closed state. It is in this state that the insert is inserted into a soft bag such as the sports bag shown in phantom lines in FIG. 15. As before, a compressive force must be exerted against the panels 218, 220 to keep the band from urging the panels 218, 220 apart to the deployed, open condition depicted in FIGS. 15 and 16.

Figure 20:
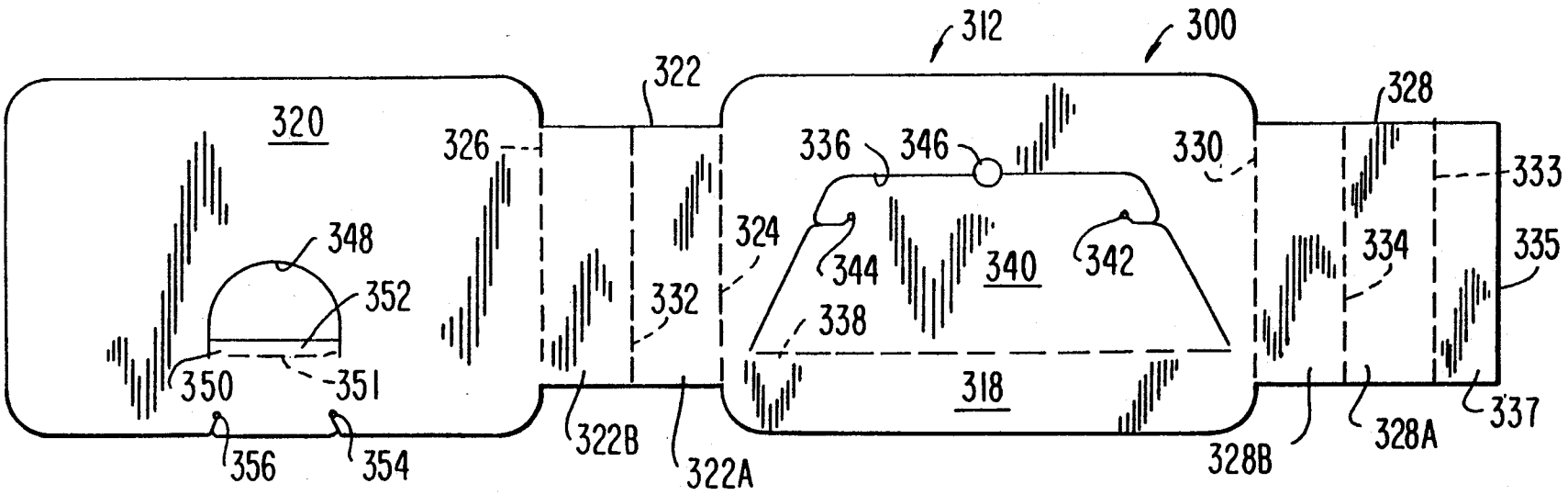
FIG. 20 is a top plan view of a fourth embodiment of a filler after manufacture and before insertion into a soft bag in accordance with this invention.
Figure 21:
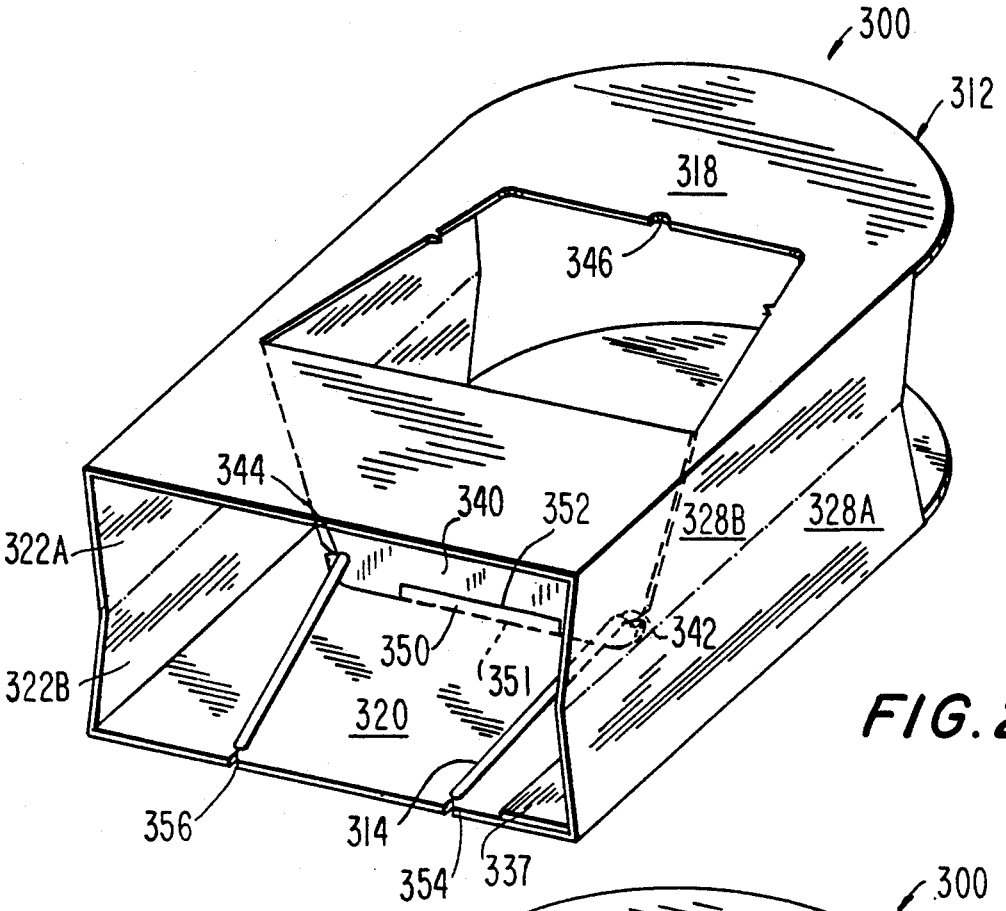
FIG. 21 is a front perspective view of the filler of FIG. 20 in a deployed state.
Figure 22:
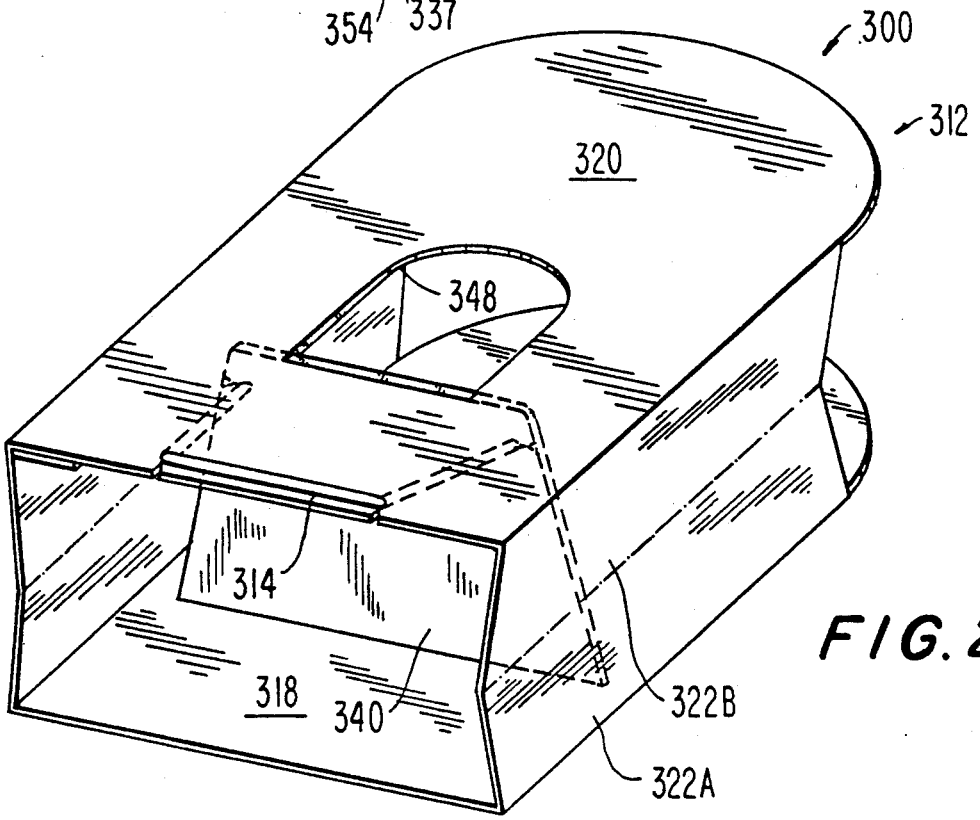
FIG. 22 is a rear perspective view of the filler of FIG. 20 in the deployed state.

Referring next to FIGS. 20 through 22, a fourth embodiment, now considered the preferred commercial embodiment to expand a backpack, of a filler 300 comprises a one-piece insert 312 and a resilient element 314. As best shown in FIG. 20, the insert 312 is constructed of a single piece of cardboard, corrugated board or the like. Insert 312 includes a pair of generally planar, sheet members or panels 318, 320; a connecting member 322 integrally hinged to panels 318, 320 along mutually parallel fold lines 324, 326, respectively; and an end member 328 integrally hinged to panel 318 at fold line 330. Another fold line 332 parallel to fold lines 324, 326 centrally divides connecting member 322 to form a pair of sections 322A, 322B thereof. Another fold line 334 parallel to fold line 330 centrally divides end member 328 to form a pair of sections 328A, 328B thereof. Still another fold line 333 and peripheral edge 335 bound an attachment strip 337. Panels 318, 320 are identical in size and have a generally rectangular configuration with rounded corners. End member 328 and connecting member 322 are also identical in size.

Panel 318 is formed with a three-sided slit 336 that bounds a generally trapezoidal, planar flap 340 that is integrally hinged to panel 318 along fold line 338 that extends normal to the fold lines 324, 330. A pair of mounting apertures 342, 344 for the resilient element 334, as described below, is formed at the ends of slits formed in the flap 340. A fingernail notch 346 is also formed in the flap 340.

Panel 320 is formed with a semi-circular cutout or window 348. A generally planar stop tab 350 is formed between a horizontal edge 352 and a fold line 351 generally parallel to the edge 352. A pair of mounting apertures 354, 356 for the resilient element is formed in the panel 320 at a lower end thereof.

After manufacture, the insert 312 is folded along fold lines 324, 326 so that panels 318, 320 overlie each other in mutual parallelism. End member 328 is folded along fold line 330 so that end member 328 and connecting member 322 are also in mutual parallelism. Attachment strip 337 is folded along fold line 330 and is connected to panel 320, typically with an adhesive to form a closed box for the insert 312.

The resilient element 314, advantageously a rubber band, is mounted on the insert 312. Flap 340 is pushed inwardly out of its initial co-planar relation with panel 318 to an intermediate position between the panels 318, 320. Stop tab 350 is also pushed inwardly out of its initial co-planar relation with panel 320, into a position generally perpendicular thereto. Then, one end of the band is inserted through slit 336, then mounted in apertures 342, 344, and then pulled under tension through the lower end of the insert 312, and then mounted in the apertures 354, 356. The insert 312 is illustrated in its deployed, open condition in FIGS. 21 and 22. The stretched band forcefully pulls the flap 340 down until the flap 340 abuts against the stop tab 350.

It will be understood that each of the elements described above, or two or more together, also may find a useful application in other types of constructions differing from the types described above.

While the invention has been illustrated and described as embodied in a bag expanding filler, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A filler for automatically expanding a soft bag from a collapsed condition to an expanded condition, comprising:

a) an insert including a pair of generally planar, mutually parallel, sheet members, one of the sheet members having a slit therein bounding a generally planar flap, said flap being initially co-planar, and integrally hinged, with said one sheet member for pivoting movement between a generally flattened state in which the flap lies generally parallel to the other of the sheet members, and a deployed state in which the flap extends transversely between the sheet members;

b) the insert further including a connecting member of one-piece construction with, and integrally hingedly connected along a pair of hinge lines to, the sheet member, said connecting member including a fold line located between, and extending generally parallel to, the hinge line; and c) biasing means connected between the flap and said other sheet member, for constantly biasing the sheet members apart from each other to the deployed state.

2. The filler according to claim 1, wherein the insert is constituted of a corrugated board material.

3. The filler according to claim 1, wherein the flap is co-planar with said one sheet member in the flattened state.

4. The filler according to claim 1, wherein the flap is located between the sheet members in the flattened state.

5. The filler according to claim 1, wherein the flap and said other sheet member have mounting apertures, and wherein the biasing means is mounted in the apertures.

6. The filler according to claim 5, wherein the flap has a generally trapezoidal shape.

7. The filler according to claim 1; and further comprising stop means on said other sheet member, for abutting against the flap in the deployed state.

8. The filler according to claim 7, wherein the stop means includes a tab extending from said other sheet member in a plane generally perpendicular to said other sheet member.

9. The filler according to claim 1, wherein the biasing means is an elastic band mounted on the flap and said other sheet member.

* * * * *